United States Patent [19]

Becker

[11] Patent Number: 4,985,110

[45] Date of Patent: Jan. 15, 1991

[54] LABELLING APPARATUS

[75] Inventor: Werner Becker, Hirschhorn, Fed. Rep. of Germany

[73] Assignee: Esselte Meto International Produktions GmbH, Hirschhorn, Fed. Rep. of Germany

[21] Appl. No.: 453,926

[22] Filed: Dec. 19, 1989

[30] Foreign Application Priority Data

Dec. 21, 1988 [DE] Fed. Rep. of Germany ..... 3843113

[51] Int. Cl.[5] ..... B65C 11/00

[52] U.S. Cl. ..... 156/540; 156/577; 156/579; 156/DIG. 48; 156/DIG. 49

[58] Field of Search ..... 156/540, 541, 543, 574, 156/577, 579, 584, DIG. 48, DIG. 49

[56] References Cited

U.S. PATENT DOCUMENTS

| | | | |
|---|---|---|---|
| 4,008,119 | 2/1977 | Hermann | 156/DIG. 48 |
| 4,382,835 | 5/1983 | Sato et al. | 156/579 |
| 4,406,727 | 9/1983 | Fujita | 156/579 |
| 4,483,733 | 11/1984 | Sato et al. | 156/541 |
| 4,853,068 | 8/1989 | Becker | 156/579 |

FOREIGN PATENT DOCUMENTS 2462983 2/1975 Fed. Rep. of Germany .

*Primary Examiner*—Michael W. Ball
*Assistant Examiner*—Mark A. Osele
*Attorney, Agent, or Firm*—Sixbey, Friedman, Leedom & Ferguson

[57] ABSTRACT

A labeling apparatus (10) is described with the aid of which labels can be imprinted and/or dispensed. The apparatus comprises a housing (12) in which a transport means for a label strip is disposed. The label strip runs in the apparatus (10) from a supply roll (26) round a deflection edge (32), then along a housing bottom (30) adapted to be pivoted out of the housing (12) to a transport roll carried by the housing bottom (30) and pivotal about an axis (52) to an exit slot, a drive connection existing between the transport roll (38) and an operating lever (16) pivotal between a rest position and a pulled position. The drive connection includes a rack (50) which is in engagement with a pinion (54) mounted on the shaft (52) of the transport roll (38) and is articulately connected to one arm (48) of a two-armed pivot lever (46) which is pivotal about an axis (44) stationary with respect to the axis (52) of the transport wheel (38). The two arms (42, 48) of the pivot lever (46) are arranged in the pivot path of the operating lever (16) in such a manner that on pivoting thereof a movement transmission to the arm (42) of the two-armed pivot lever (46) takes place while on return of the operating lever (16) into its rest position a transmission from the operating lever (16) to the other arm (48) of the pivot lever (42) takes place.

3 Claims, 4 Drawing Sheets

LABELLING APPARATUS

Figure 1:
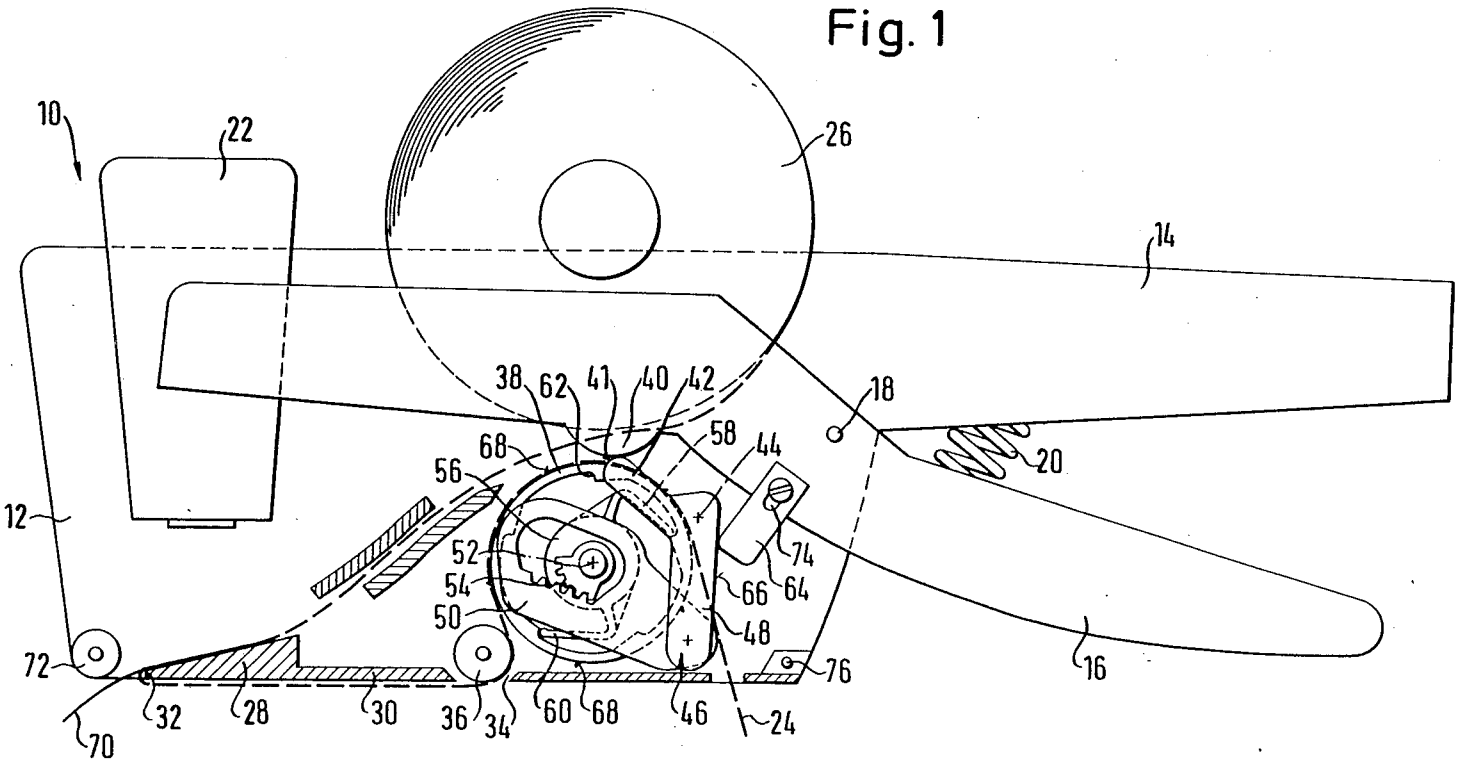

The invention relates to a labelling apparatus for imprinting and/or dispensing labels comprising a housing, a transport means for a label strip which runs in the apparatus from a supply roll over a deflection edge, then along a housing bottom adapted to be pivoted out of the housing, through an introduction slot in the housing bottom to a transport roll carried by the housing bottom and rotatable about an axis and finally to an exit slot, a drive connection existing between the transport roll and an operating lever pivotal between a rest position and a pulled position.

A label machine of this type is known from EP-Al-0 039 803. In this known apparatus between the operating lever and the transport roll a thrust rod is disposed which is connected at one end articulately to the operating lever and at the other end can be brought into engagement with studs which are arranged along a circle on an end face of a transport roll projecting axially from the latter. The thrust rod acts like a pawl in that by acting on one of the studs it turns the transport roll through a predetermined angle when it advances a forward force on one of the studs on pivoting of the operating lever out of the pulled position to the rest position. On each pivoting of the operating lever out of the rest position into the pulled position the thrust rod detaches itself from a stud and assumes a position in which on pivoting of the operating lever into the rest position it can act on the next stud for further rotation of the transport roll. Since the thrust rod is mounted directly on the operating lever its thrust travel depends solely on the displacement which the connection point between the thrust rod and the operating lever undergoes on pivoting of the latter. The rotation angle of the transport roll is also defined accordingly and due to the direct drive connection the rotational angle which can be achieved is limited. This means however that the distance through which the label strip can be pulled round the deflection edge on each rotation of the transport wheel initiated by the thrust rod is fixed at a relatively small value. The known apparatus is not suitable for the use of relatively long labels which require a greater advance distance for their detachment at the deflection edge.

DE-PS 2,462,983 describes a labelling apparatus in which on the operating lever a toothed segment is disposed which meshes with a pinion which is in engagement with a pinion driving a transport pawl. The transport pawl is mounted on the shaft of the transport roll which is coupled via a oneway coupling to said shaft. On movement of the operating lever from the rest position into the pulled position only the transport pawl is turned whilst the transport wheel due to the installation of the one-way coupling remains stationary. On release of the operating lever and return thereof to the rest position the transport pawl through the engagement at teeth on the transport wheel drives said wheel, which then turns through a predetermined angle. This rotational angle is defined solely by the transmission ratio between the toothed segment and the pinion on the transport pawl. This transmission ratio cannot be arbitrarily varied and consequently the distance through which the carrier strip can b moved by means of the transport roll is also only limited This means a disadvantageous restriction of the possible uses of labels of different size which can be dispensed with the apparatus.

The invention is based on the problem of providing a labelling apparatus of the type set forth at the beginning which with simple construction without changing the construction principles permits adaptation to labels of different length.

According to the invention this problem is solved in that the drive connection includes a rack which is in engagement with a pinion mounted on the shaft of the transport roll and is articulately connected to one arm of a two-armed pivot lever which is pivotal about an axis stationary with respect to the axis of the transport wheel and that the two arms of the pivot lever are arranged in the pivot path of the operating lever in such a manner that on pivoting thereof from the rest position to the pulled position a movement transition from the operating lever to the one arm of the two-armed lever takes place whilst on the return of the operating lever from the pulled position into the rest position a movement transmission from the operating lever to the other arm of the two-armed lever takes place.

In the labelling apparatus according to the invention the operating lever for driving the transport roll does not act directly on the rack coupled to said roll via the pinion but on its movement it pivots the two-armed pivot lever which in turn effects the displacement of the rack. Interposition of the pivot lever into the drive connection makes it possible, utilizing the leverage, to obtain a larger or smaller displacement of the rack depending on where the operating lever comes into engagement on the pivot lever and thus to produce a correspondingly greater or smaller rotation angle of the transport roll. The nearer the engagement point lies to the axis of rotation of the pivot lever the greater the displacement path of the rack, for the same movement of the operating lever, and thus the greater the rotational angle of the transport roll. In this manner the possible use of the labelling apparatus for labels of different sizes is not restricted.

Further developments of the invention are characterized in the subsidiary claims.

Figure 2:
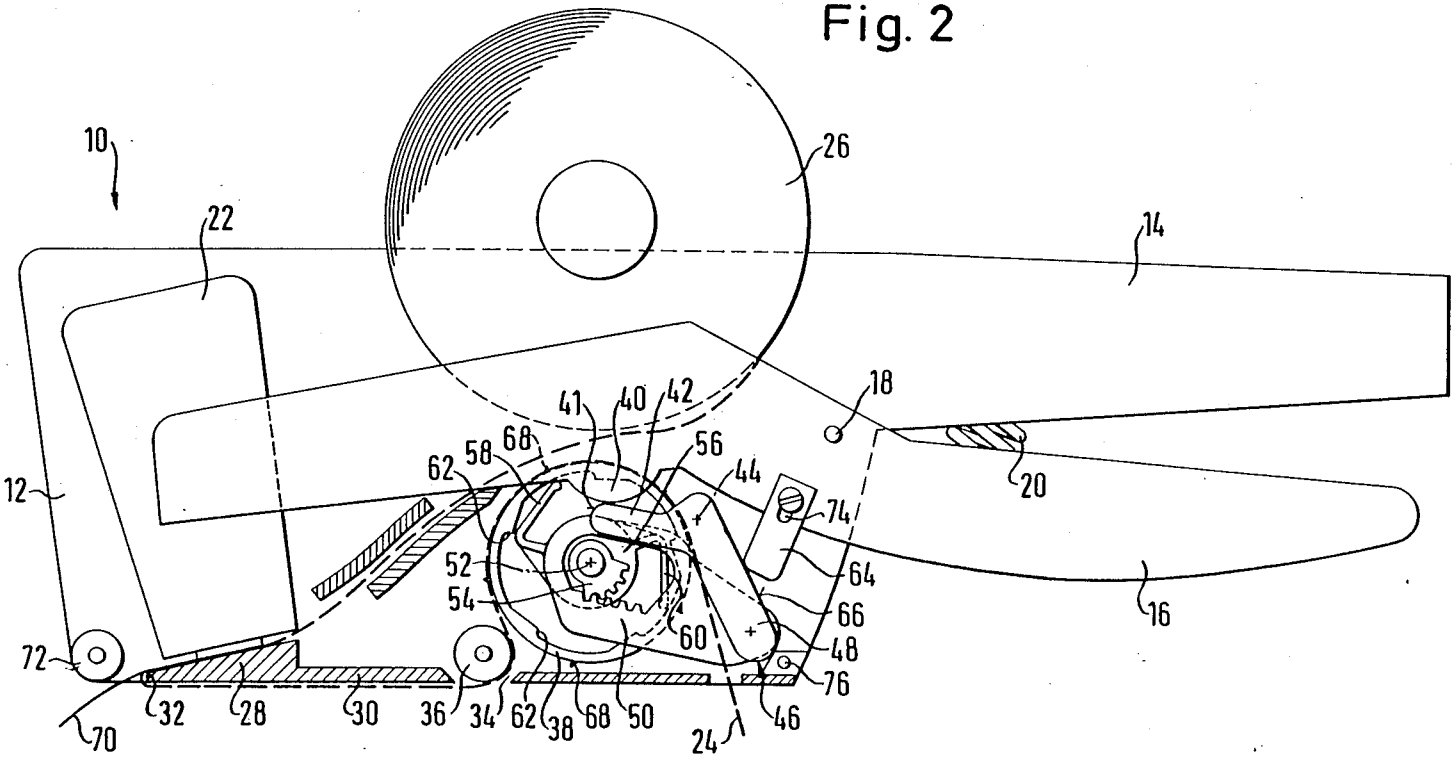
Figure 3:
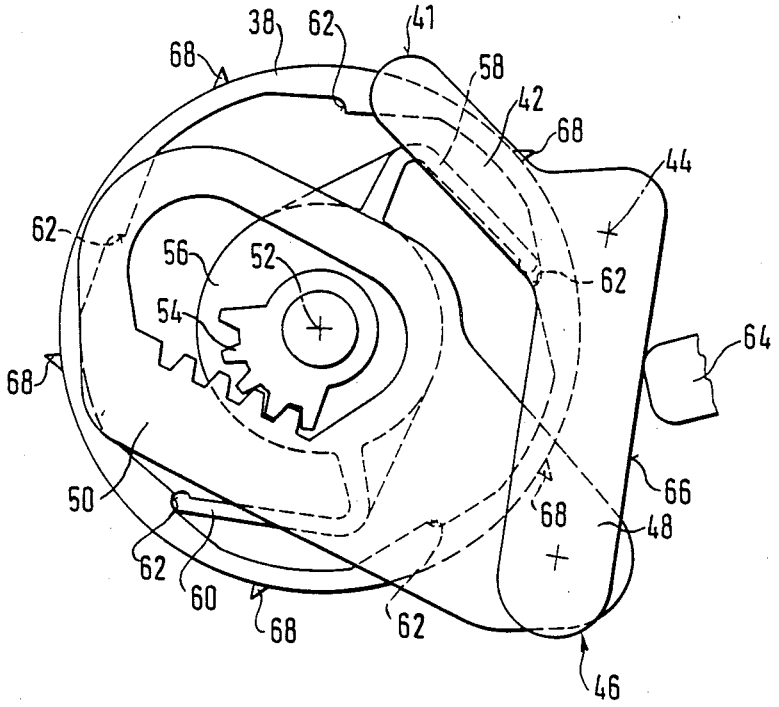
Figure 4:
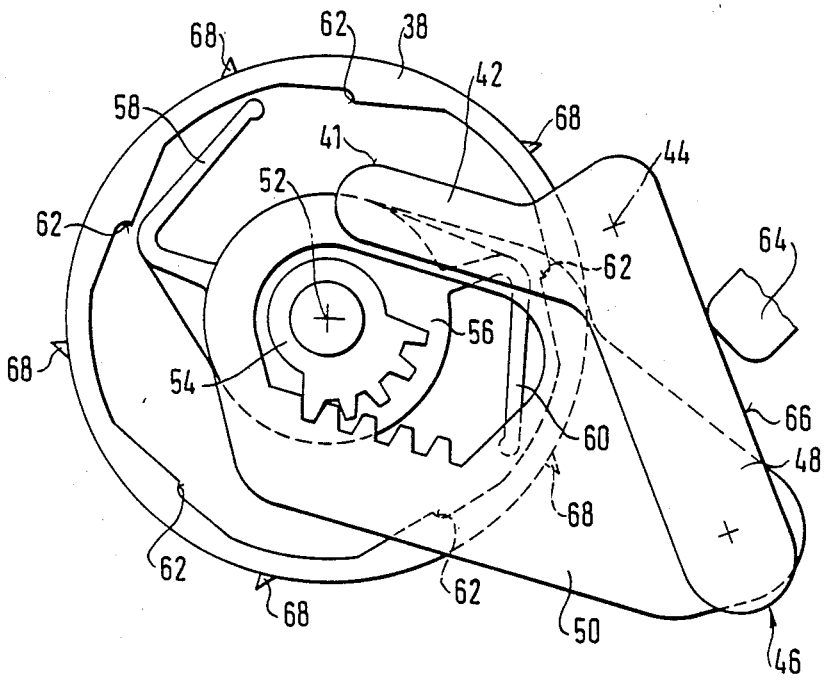

The invention will now be explained by way of example with the aid of the drawings, wherein:

FIG. 1 shows a schematic side view of a labelling apparatus according to the invention, all the moving parts being in the rest position, FIG. 2 shows a similar schematic side view of the labelling apparatus of FIG. 1, the moving parts assuming the positions reached after movement of the operating lever into the pulled position, FIG. 3 is an enlarged representation of the transport roll or wheel with the associated drive parts in the position of FIG. 1 and FIG. 4 is a view of the transport roll and the associated drive parts in the position of FIG. 2.

The labelling apparatus 10 illustrated schematically in FIG. 1 permits the imprinting, dispensing and applying of self-adhering or pressure-sensitive labels which are disposed on a carrier strip. If the self-adhering labels however have already been provided with imprints the components provided for the printing can be omitted. However, with the apparatus labels can also be handled which are not disposed on a carrier strip but form a continuous label strip of which the labels are imprinted in the apparatus and then, still connected together, dispensed from the apparatus. These imprinted labels are then separated by hand and applied to the articles for sale.

The labelling apparatus 10 comprises a housing 12 shown in its outlines and provided at its end lying on the right in FIG. 1 with a grip 14. An operating lever 16 is mounted in the housing pivotally about a pin 18. The operating lever 16 is held in the rest position shown in FIG. 1 by a spring 20 tensioned between said lever and the grip 14. The operating lever 16 carries a printing mechanism 22 at its end lying on the left in FIG. 1.

The self-adhering labels to be imprinted, dispensed and applied with the aid of the labelling apparatus 10 are initially disposed on a carrier strip or tape 24 which is coiled to a supply roll 26 which is inserted into the housing 12. In the ready-to-use state the carrier strip with the selfadhering labels stuck thereto first runs over a printing table 28 which can be part of a housing bottom 30. At the front end of the printing table 28 the carrier strip is deflected in an acute angle about a dispensing edge 32 and it then runs along the housing bottom 30 rearwardly up to an introduction slot 34. Said introduction slot 34 is defined on the left side lying in FIG. 1 by a deflection roller 36 which deflects the carrier strip 24 in a direction running tangentially to a transport wheel 38. The construction and function of the transport roll will be explained in more detail in connection with the description of an operating cycle of the labelling apparatus 10.

To operate the labelling apparatus 10 the operator pulls the operating lever 16 against the action of the spring 20 in the direction towards the grip 14 and as a result the printing mechanism 22 is lowered in the direction towards the self-adhering label then on the printing table 28 and produces the desired imprint on said label With the lowering of the operating lever 16 a lug 40 on the operating lever 16 comes into engagement with a stop face 41 on an arm 42 of a two-armed pivot lever 46 pivotal about an axis 44 because said arm lies in the movement path of the lug 40. As a result the pivot lever 46 is pivoted anticlockwise and consequently the other arm 48 of the pivot lever 46 moves to the right in the illustration of FIG. 1. The end of the arm 48 of the pivot lever 46 is articulately connected to a rack 50 which meshes with a pinion 54 connected non-rotatably to the shaft 52 of the transport roll 38.

The transport roll 38 is coupled with the aid of a one-way coupling, not shown in the drawings, to the shaft 52 and as a result it can rotate only in one direction on the shaft 52, that is clockwise. The pinion 54 is fixedly connected to a pawl body 56 on which two transport pawls 58 and 60 are arranged.

The transport wheel 38 comprises an inner peripheral face on which driver teeth 62 located at equal intervals apart are disposed.

When on pivoting of the operating lever 16 and the resulting pivoting of the two-armed pivot lever 46 the rack 50 moves to the right in the illustration of FIG. 1 the pinion 54 and the pawl body 56 connected fixedly thereto are turned anticlockwise on the shaft 52. When this happens the transport roller 38 does not rotate as well because due to the use of a one-way coupling it can be turned only clockwise. The rotation of the pawl body 56 continues until the transport pawls 58, 60 at least come to lie respectively behind one of the driver teeth 62 which are next in the anticlockwise direction. In FIG. 2 the position of the individual parts in this operating phase is shown. The individual parts can be seen more exactly in the enlarged illustration of FIG. 3 which shows the parts in the mutual position of FIG. 1 whilst FIG. 4 shows the parts in the respective position of FIG. 2.

If now the operating lever 16 is released it returns from the pulled position of FIG. 2 by rotation about the axis 18 to the rest position of FIG. 1. In this return movement a further lug 64 disposed on the operating lever 16 acts on a stop face 66 on the two-armed pivot lever 46. The pivot lever 46 is thereby pivoted clockwise about its axis 44, displacing the rack 50 to the left in the illustration of FIG. 2. Due to the movement transmission from the rack 50 to the pinion 54 the pawl body 56 is also rotated clockwise so that the transport pawls 58, 60 by acting on the driver teeth 62 turn the transport wheel 38 clockwise. The rotational angle depends here, if the transmission ratio between the rack 50 and the pinion 54 is fixed, on the displacement of the rack 50 to the left. The displacement travel of the rack 50 in turn depends on how far the pivot lever 46 is pivoted clockwise about the axis 44 by the action of the lug 64. The nearer the action point of the lug 64 on the corresponding stop face 66 of the pivot lever 46 lies to the axis 44 the further the end of the arm 48 connected to the rack 50 moves, assuming that the operating lever 16 always covers the same pivotal travel.

As can be seen in FIGS. 1 and 2 the carrier strip 24 in the rest position of the apparatus according to FIG. 1 is wrapped round the transport roll 38 and penetrated by the teeth 68 of said transport roll or wheel. Thus, when the transport roll 38 turns clockwise it exerts on the carrier strip 24 a tensile force which results in the carrier strip 24 being pulled from the supply roll 26 over the printing table 28 and round the deflection edge 32. The rotational angle of the transport roll must be dimensioned so that the carrier strip 24 moves in each case exactly through a distance corresponding to the length of a label. As a result, in each cycle a label first moves onto the printing table 28 so that it can be imprinted and then into the dispensing position in front of the deflection edge 32 as is illustrated with respect to the label 70. This label 70 located in the dispensing position can then be applied to an article by rolling the roller 72 on the article, adhering the label 70 thereto.

The components decisive for the transport of the carrier strip 24 can easily be modified, retaining their construction principle, to give another transport distance so that labels of a different length can be imprinted and dispensed. A first adaptation possibility to a different label length is by changing the diameter of the pinion 54 so that a different transmission ratio becomes effective between the rack 50 and the pinion 54. It is possible thereby for example to cause the pawl body 56 on displacement of the rack to the right to rotate to such an extent that the transport pawls 58, 60 do not come to lie behind the next tooth in the anticlockwise sense but behind the tooth adjacently following the next tooth as soon as the operating lever 16 has reached its pulled position. As a result, on releasing the operating lever 16 the transport roll 38 is rotated a substantially greater angle than would be the case if the transport pawls 58, 60 engaged respectively only behind the next driver tooth.

A further possibility of changing the carrier belt movement which can be achieved by means of the transport roll 38 is by making the lug 64 on the operating lever 16 adjustable as regards its engagement point on the arm 48 of the pivot lever 46. This adjustment possibility is indicated in FIGS. 1 and 2 schematically in that the lug 64 is provided with a slot 74 which permits a displacement on the operating lever 16. The adjustment possibility will not be explained in detail here because the expert has at his disposal a great number of possibilities for this purpose. The important point is only that in this adjustment the distance of the engagement point of the lug 64 on the arm 48 of the pivot lever from the axis 44 is changed. As a result different leverages become effective so that for the same movement of the operating lever 16 a greater or smaller pivot angle of the pivot lever 46 is achieved and this results in a greater or smaller linear displacement of the rack 50.

With the indicated possibilities of influencing the turning of the pawl body 56 on the one hand and the engagement point 64 on the arm 48 of the pivot lever 46 on the other hand an excellent adaptation of the labelling apparatus 10 to the label length to be used can be achieved.

To make the interior of the labelling apparatus 10 accessible the housing bottom 30 can be pivoted out of the housing 12 about a fulcrum 76. Said housing bottom 30 carries the entire assembly responsible for the carrier strip transport or feed. This enables said assembly to be cleaned easily with the housing bottom 30 pivoted out and freed of any self-adhering labels possibly stuck in the interior of the apparatus due to a malfunction. Since the drive connection between the operating lever 16 and the transport means results solely from the action of the lugs 40 and 64 on the pivot lever 46 the pivoting out of the housing bottom with the transport means can readily be performed and on pivoting back into the closed position there is no need to ensure that individual components assume certain predefined positions. In each case the components automatically reassume their proper positions.

I claim:

1. In a labelling apparatus comprising a housing, a transport means for a label strip which runs in the apparatus from a supply roll over a deflection edge, then along a housing bottom which is adapted to be pivoted out of the housing, through an introduction slot in the housing bottom to a transport roll carried by the housing bottom and rotatable about an axis and finally to an exit slot, a drive connection existing between the transport roll and an operating lever pivotal between a rest position and a pulled position, the improvement comprising a drive connection including a rack (50) which is in engagement with a pinion (54) mounted on the shaft (52) of the transport roll (38) and is articulately connected to one arm (48) of a two-armed pivot lever (46) which is pivotal about an axis (44) stationary with respect to the axis (52) of the transport wheel (38) and that the two arms (42, 48) of the pivot lever (46) are arranged in the pivot path of the operating lever (16) in such a manner that on pivoting thereof from the rest position to the pulled position a movement transmission from the operating lever (16) to the one arm (42) of the two-armed pivot lever takes place whilst on the return of the operating lever (16) from the pulled position into the rest position a movement transmission from the operating lever (16) to the other arm (48) of the two-armed pivot lever (46) takes place.

2. Labelling apparatus according to claim 1, characterized in that the operating lever (16) is constructed a two-armed lever, that on each arm of the operating lever a lug (40, 64) is disposed and that the lug (40) on one arm of the operating lever (16) during the pivoting thereof from the rest position to the pulled position comes into engagement with a stop face on an arm (42) of the pivot lever (46) whilst the lug (64) of the other arm of the operating lever (16) on pivoting thereof from the pulled position into the rest position comes into engagement with a stop face (66) on the other arm (48) of the pivot lever (46).

3. Labelling apparatus according to claim 2, characterized in that at least the lug of the other arm (64) of the operating lever (16) is adjustable for varying the engagement point on the pivot lever (46)

* * * * *